US007413419B2

(12) United States Patent
De Smedt et al.

(10) Patent No.: US 7,413,419 B2
(45) Date of Patent: Aug. 19, 2008

(54) WATER-INJECTED SCREW COMPRESSOR

(75) Inventors: Emiel Lodewijk Clement De Smedt, Keerbergen (BE); Jan Paul Herman Heremans, Antwerpen (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 537 days.

(21) Appl. No.: 10/467,069

(22) PCT Filed: Mar. 6, 2002

(86) PCT No.: PCT/BE02/00028

§ 371 (c)(1),
(2), (4) Date: Dec. 11, 2003

(87) PCT Pub. No.: WO02/070900

PCT Pub. Date: Sep. 12, 2002

(65) Prior Publication Data

US 2004/0086396 A1 May 6, 2004

(30) Foreign Application Priority Data

Mar. 6, 2001 (BE) ..... 2001/0148

(51) Int. Cl.
*F04B 17/00* (2006.01)
*F04B 35/04* (2006.01)

(52) U.S. Cl. ..... 417/410.4; 417/410.3

(58) Field of Classification Search ..... 417/410.3, 417/410.4; 418/201.1, 97, 104, 112, 125; 310/54, 90, 261, 45, 43, 89
See application file for complete search history.

(56) References Cited

U.S. PATENT DOCUMENTS

| | | | | | |
|---|---|---|---|---|---|
| 1,979,851 | A | * | 11/1934 | Andresen | 417/372 |
| 2,623,469 | A | * | 12/1952 | Gray | 417/310 |
| 2,831,662 | A | * | 4/1958 | Hirsch | 165/156 |
| 2,862,120 | A | * | 11/1958 | Onsrud | 310/54 |
| 2,915,656 | A | * | 12/1959 | Schwan | 310/57 |
| 2,964,659 | A | * | 12/1960 | Steele, III et al. | 310/54 |
| 3,961,862 | A | * | 6/1976 | Edstrom et al. | 417/282 |
| 4,781,553 | A | * | 11/1988 | Nomura et al. | 418/104 |

(Continued)

FOREIGN PATENT DOCUMENTS

| | | |
|---|---|---|
| DE | 19745616 | 4/1999 |
| JP | 47-19963 | 7/1972 |
| JP | 54-154811 | 12/1979 |
| JP | 10-054384 | 2/1998 |
| JP | 11-280681 | 10/1999 |

(Continued)

*Primary Examiner*—Devon Kramer
*Assistant Examiner*—Jessica L Frantz
(74) *Attorney, Agent, or Firm*—Bacon & Thomas, PLLC

(57) ABSTRACT

The invention relates to a water-injected screw compressor, comprising a compressor element (2) with a housing (7) which borders a compression chamber (8) in which two rotors (9, 10) are installed, which, by means of an axle ends (13, 14; 15, 16), are borne in the housing (7) by means of water-lubricated slide bearings (1), an electric motor (3) comprising a housing (18) which carries a stator (19) at the inside, which stator surrounds a rotor (21) with a rotor shaft (22). An axle end (13) of one of the rotors (9) is directly coupled to or forms one piece with the rotor shaft (22) of the motor (3), said rotor shaft being located in the prolongation of said axle end. The rotor shaft (22) of the motor (3) is borne in at least one water-lubricated slide bearing (23).

11 Claims, 2 Drawing Sheets

U.S. PATENT DOCUMENTS 4,792,462 A * 12/1988 Smith et al. ..... 427/545
4,982,126 A * 1/1991 Jolivet et al. ..... 310/90
4,983,106 A * 1/1991 Wright et al. ..... 418/2
5,037,282 A * 8/1991 Englund ..... 418/98
5,083,802 A * 1/1992 Shimasaki et al. ..... 277/560
5,167,496 A * 12/1992 Jacobsson et al. ..... 418/102
5,222,874 A * 6/1993 Unnewehr et al. ..... 417/372
5,446,995 A * 9/1995 Huber ..... 47/86
5,448,123 A * 9/1995 Nilson et al. ..... 310/261
5,466,995 A * 11/1995 Genga ..... 318/3
5,626,470 A * 5/1997 Gerhardt ..... 418/84
5,846,062 A * 12/1998 Yanagisawa et al. ..... 417/410.4
6,005,312 A * 12/1999 Yamane ..... 310/67 R
6,095,780 A * 8/2000 Ernens ..... 418/104
6,133,659 A * 10/2000 Rao ..... 310/89
6,177,744 B1 * 1/2001 Subler et al. ..... 310/90
6,302,667 B1 * 10/2001 Timuska et al. ..... 418/201.1
6,371,742 B1 * 4/2002 Gigon ..... 418/2
6,544,020 B1 * 4/2003 Bahnen et al. ..... 418/88

FOREIGN PATENT DOCUMENTS

JP 2000-097186 4/2000
WO WO 9913224 A1 * 3/1999

* cited by examiner

WATER-INJECTED SCREW COMPRESSOR

FIELD OF THE INVENTION

This invention relates to a water-injected screw compressor, comprising a compressor element with a housing, which borders a compression chamber with two rotors therein, and an electric motor for driving the compressor element.

BACKGROUND

Water-injected screw compressors often are chosen above oil-injected or oil-free screw compressors.

With oil-injected screw compressors, the produced air in fact is not free of oil.

With classic oil-free screw compressors without an injection of lubricating liquid, the compressor part is connected to the motor by means of a gearwheel case with oil lubrication. Here, the rotational speed of the rotors is higher.

Compared to such classic oil-free screw compressor, a water-injected screw compressor has a number of advantages. First, an outlet pressure up to 15 bar can be obtained in one stage instead of in two or three stages. Therefore, the compressor can be realised less expensive and more compact. Also, due to the lower working temperature, coolers may be sufficient which are simpler than with the classic oil-free screw compressors. Moreover, the water-injected screw compressor has a lower noise production and a higher efficiency. Moreover, as no oil or grease is used, no additional maintenance is necessary and the compressor is more environmental-friendly as there is no waste oil or grease.

With the water-injected screw compressor, water is injected onto the rotors in order to cool, seal and lubricate the rotors, whereby the male rotor directly drives the female rotor.

It is obvious that in this application, by "water" not necessarily 100% pure water is intended. This water may comprise additives, such as anti-corrosive means and/or freezing point depressing means.

Water is also injected for lubricating the slide bearings in which the male and the female rotors are borne by means of axle ends.

In the compression chamber, the air is compressed and driven out together with the water through an outlet. The air-water mixture then is transported off to a vessel/water separator, where the major part of the water is separated. The water is collected in the vessel, at the bottom thereof, and the compressed air is transported off at the top.

The speed range of a water-injected screw compressor is higher than that of an oil-injected screw compressor, amongst others, due to the lower viscosity and the higher heat capacity of water. If a water-injected screw compressor should be driven directly by an electric motor, this motor thus would have to run faster than with an oil-injected screw compressor, which leads to problems for the bearing of the motor as well as for the cooling of the motor.

SUMMARY

The present invention aims at providing a water-injected screw compressor which solves the aforementioned problems and which allows a direct drive without a gearwheel case, as a result of which said compressor becomes more compact and less expensive.

To this aim, the invention consists of a water-injected screw compressor, comprising a compressor element with a housing which borders a compression chamber in which a male rotor and a female rotor are installed, which, by means of axle ends, are borne in the housing by means of water-lubricated slide bearings, an electric motor for driving said compressor element, which motor comprises a housing which carries a stator at the inside, which stator surrounds a rotor with a rotor shaft, a pressure conduit which connects to the compression chamber, a vessel, which also is a water separator, in the pressure conduit, and a water return between the vessel and the compression chamber, the characterising feature of which consists in that an axle end of one of the rotors is directly coupled to or forms one piece with the rotor shaft of the motor, said rotor shaft being located in the prolongation of said axle end, and that also the rotor shaft of the motor is borne in at least one water-lubricated slide bearing.

The fact that the axle of the compressor element is coupled directly, in other words, without gearwheel transmission, and thus with a transmission ratio of 1/1, or forms one piece with the shaft of the motor situated in the prolongation thereof, offers the advantage that a bearing can be economised.

U.S. Pat. No. 5,222,874 describes an oil-lubricated screw compressor in which the axle end of one of the rotors forms a whole with the rotor shaft of the electric motor. The rotor, which is connected to this rotor shaft, is borne with its axle ends at both extremities in the housing of the compressor element, however, the rotor shaft of the motor in itself is not borne. Therefore, amongst others, the compressor necessarily must be installed vertically. The bearings-also are no slide bearings, but roller bearings, which renders water lubrication impossible. Oil flows downward by gravity from the top of the motor towards the inlet side of the compressor element, where a small under-pressure exists DE-A-197 45 616 describes a vacuum pump. There is, amongst others, no injected compressor element, vessel or return conduit. The pump part exclusively comprises a two-part rotor, an extremity of which forms a whole with the rotor shaft of the electric motor. This rotor shaft is borne at both extremities, contrary to the rotor of the pump part. Also in this vacuum pump, the bearings are no slide bearings, but ball bearings. Although the use of water as a lubrication agent is stated as possible, oil clearly is preferred and only an example with oil cooling is represented. The cooling agent comes into contact with the electric motor, such that water is not suitable.

According to the invention, the housing of the motor and the housing of the compressor element preferably also are integrated to form a whole.

Of course, there is a risk that water, used for the lubrication of the slide bearings, gets into the inner space of the housing of the motor and causes a short circuit there.

In order to avoid this, in one form of embodiment the inner space of the housing around the whole formed by the rotor shaft of the motor and the axle end connected thereto, at the inside of each of the slide bearings situated at opposite sides of the rotor, is sealed by a lip seal which is directed with its free extremity towards the slide bearing, whereas the inner space of the housing of the motor, by means of at least one conduit, is in connection with a source of blocking gas under pressure.

In the compressor according to U.S. Pat. No. 5,222,874, around the shaft no sealing is present between the housing of the compressor element and the motor housing. Cooling agent comes into contact with the rotor of the motor, such that also for this reason, no water can be used as a cooling agent.

In the vacuum pump according to DE-A-19745 616, around the shaft two shaft sealings are provided between the housing of the pump part and the housing of the motor, however, the inner space of the housing of the motor can not be connected to a source of blocking gas under pressure. The sealings always press against the shaft, also during rotation of the shaft.

According to the invention, sealing only takes places during a standstill, however, during rotation of the shaft, blocking gas is added to the space, as a result of which the lip seal is lifted and the friction is minimum.

According to the invention, this source of blocking gas preferably is the pressure conduit or the vessel, whereby then in the conduit between this pressure conduit or vessel and the inner space of the motor, a water separator and preferably also a restrictor are installed.

When the compressor is operating, the lip seals are lifted, as a result of which wear and tear of these lip seals is avoided. When the compressor stands still, the lip seals clamp around the shaft of the motor, such that the sealing remains guaranteed.

In another form of embodiment, the windings of the stator and the rotor are treated with an electrically insulating material, for example, silicones, and instead of seals, one or more drain conduits are provided at the side of each of the water-injected slide bearings directed towards the rotor, which slide bearings are situated on opposite sides of the rotor.

In this case, a limited amount of humidity in the motor compartment is tolerable. Humid air, which penetrates into the inner space of the motor or is blown therein, improves the cooling and efficiency of the motor.

This form of embodiment has as advantages that fewer parts are necessary and the design thus becomes simpler. The lip seals are redundant, as a result of which also the maintenance thereof is omitted and the mantle of the motor no longer must be provided with channels for cooling.

The water-lubricated slide bearing of the rotor shaft of the motor preferably is in connection with a water source, by means of a conduit, which water source is formed in particular by said water return, in particular said vessel/water separator therein.

Due to the water lubrication of the slide bearing of the rotor shaft of the motor, not only a good bearing, but also a certain cooling is realised, however, preferably the compressor is provided with extra cooling means for cooling the stator.

In a form of embodiment, these cooling means, amongst others, comprise at least one channel, which is provided through the housing and is connected to a water source, in particular said water return, including the vessel/water separator.

Therefore, no additional water source is necessary.

The channel in the housing may also be connected to an external source of cooling water when such source is available. In this case the requirements for the material of the housing are less severe. No water enters the compression chamber or the bearings so that the water must not be completely free from small particles.

The aforementioned cooling means may comprise cooling fins, which are provided on the housing of the motor.

BRIEF DESCRIPTION OF THE DRAWINGS

With the intention of better showing the characteristics of the invention, hereafter, as an example without any limiting character, a preferred form of embodiment of a water-injected screw compressor according to the invention is described, with reference to the accompanying drawings, wherein.

DETAILED DESCRIPTION

Figure 1:
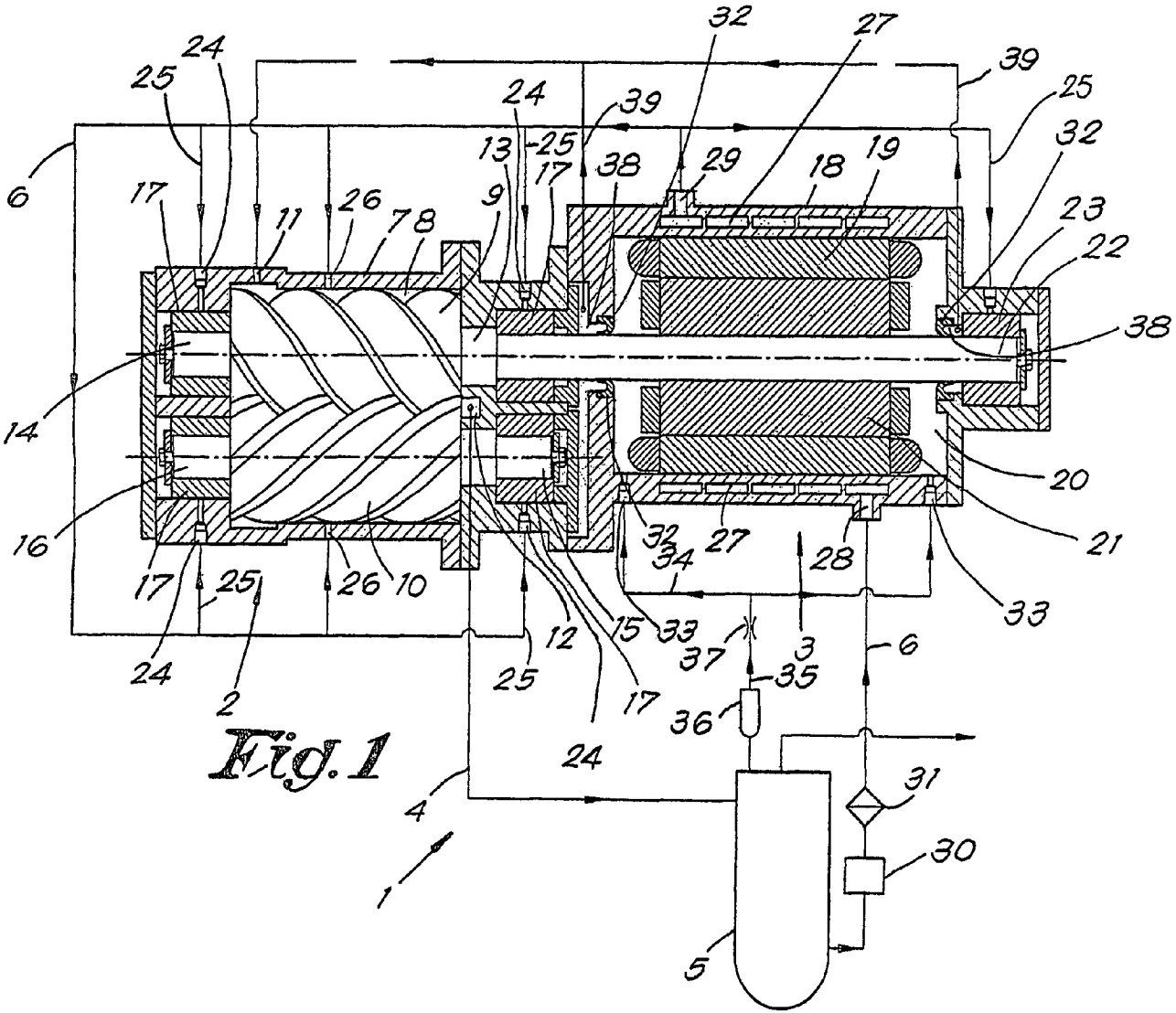
FIG. 1 schematically represents a water-injected screw compressor according to the invention.

The water-injected screw compressor 1 represented in FIG. 1 substantially consists of a water-injected compressor element 2, an electric motor 3, a pressure conduit 4, which connects to the compressor element 2, a vessel 5 which also forms a water separator in the pressure conduit 4, and a water return 6 between the vessel 5 and the compressor element 2.

The compressor element 2 substantially comprises a housing 7 in which the compression chamber 8 is situated, and two mutually engaging screw-shaped rotors situated therein, namely a male rotor 9 and a female rotor 10.

The housing 7 is provided with an air inlet 11, to which a not-represented inlet conduit is connected, and an air outlet 12, to which the pressure conduit 4 connects.

Both rotors 9 and 10 are provided with axle ends 13 and 14, 15 and 16, respectively, which are borne in the housing 7 by means of water-lubricated slide bearings 17.

The motor 3 substantially is composed of a housing 18, to the inner side of which a stator 19 is attached which borders a closed inner space 20 inside which a rotor 21 having a rotor shaft 22 is situated.

The motor 3 is directly connected to the compressor element 2. This means that the rotor shaft 22 of the motor 3 is directly attached to the axle end 13 of the male rotor 9, for example, by means of a conical extremity, which fits into a conical recess and is retained therein by means of a pin. Theoretically, the rotor shaft 22 and the axle end 13 can form one piece; however, this is less practical for the construction of the compressor.

As the axle end 13 and the rotor shaft 22 are connected to each other or form one piece, a bearing of the rotor shaft 22 can be omitted.

In the represented example, the rotor shaft 22, at its extremity most remote from the compressor element 2, is borne in the housing 18, to wit by a water-lubricated slide bearing 23. This increases the stability of the rotating whole, also when the motor 3 is relatively heavy, and it allows using rotors 9 and 10 with a body made of fibre-reinforced synthetic material, so-called composite, around a metal shaft. With such rotors, the resistance against the bending of the shaft in the rotor 9 with the axle end 13 is lower.

This permits to place the compressor element 2 horizontally. However, by means of appropriate water-lubricated slide bearings, the compressor element 2 can also be placed vertically instead of horizon-tally, such as represented.

The water-lubricated slide bearings 17 and 23 are provided with water-injection points 24 which, by means of branches 25, connect to the water return 6 which connects the bottom side of the vessel 5 to a number of injection points 26 which give out in the compression chamber 8 and provide for the injection of water into the compression chamber 8.

This water return 6 extends through the housing 18, which to this end is provided with a number of mutually connected channels 27.

By means of an inlet 28, these channels 27 are in connection with the vessel 5, and they connect to the injection points 26 by means of an outlet 29 and, by means of the branches 25, to the injection points 24. Between the vessel 5 and the inlet 28, in the water return 6 successively a cooler 30 and a water filter 31 are provided.

The branches (25) may in a variant connect to an external source of water.

Special measures are taken to prevent the penetration of water in the electrical motor 3.

Consequently, in order to prevent that water penetrates into the inner space 20, the common shaft, formed by the axle end 13 and the rotor shaft 22, at both extremities of the housing 18, is surrounded by a lip seal 32, for instance in PTFE, which is attached in the housing 18 and is directed with its free extremity away from the inner space 20.

The inner space 20 is connected to the topside of the vessel 5 by means of two inlets 33 and conduits 34 connected thereto, which conduits turn into a common conduit 35. In the conduit 35, a water separator 36 and a restrictor 37 are provided.

To the spaces 38 between each lip seal 32 and the slide bearing 17 situated opposite thereto, a drain conduit 39 for leaked-out air and water of the slide bearing 17 is connected, which conduit gives out into the compression chamber 8, at the inlet side.

With normal operation, the motor 3 directly drives the male rotor 9 of the compressor element 2. The female rotor 10, which engages therewith, then rotates along therewith, in reverse sense. Thereby, air is suctioned via the air inlet 11 towards the compression chamber 8 and is compressed. Together with water injected through the water injection points 26 for lubricating and cooling the rotors 9 and 10, and water originating from the slide bearings 17 through conduits 39, the compressed air leaves the compression chamber 8 through the air outlet 12.

This mixture of compressed air and lubricating water is pressed, through pressure conduit 4, towards the vessel 5, where the major part of the water is separated and, by means of the water return 6, is fed back to the compression chamber 8.

This water flows through the channels 27 and thereby cools housing 18 and so the stator 19.

A part of this water or water from an external source flows, through branches 25, towards the slide bearings 17 and the slide bearing 23, which thereby are lubricated and cooled.

Through conduits 34 and 35, blocking air under pressure is fed into the inner space 20.

As air under pressure from the vessel 5 is brought into the inner space 20, this latter is put under slight overpressure, as a result of which the lip seals 32 are lifted somewhat and there is no wear and tear of these lip seals 32 against the co-operating contact ring of the rotor shaft 22 when the shafts 22 starts and rotates, also when water is used for lubricating.

When the compressor stands still and the pressure in the vessel 5 and, thus, also in the inner space 20 has dropped to almost the atmospheric pressure, the lip seals 32 no longer are lifted, but rest against the combination of the axle end 13 and the rotor shaft 22.

These lip seals 32 are called reverse lip seals, on account of the fact that they thus effect in a reverse manner in respect to the classic lip seals. These classic lip seals rest also during rotation of the shaft against this shaft and often will rest against it even stronger than during standstill, what would give excessive wear if not oil but water would be used as lubricant.

Air leaking through the lip seal 32 towards the slide bearing 17 is transported off together with water from the slide bearings 17, through drain conduit 39, towards the compression chamber 8.

The restrictor 37 provides for the blocking air to expand in the conduit 35, which provides for a reduction of the relative humidity thereof. As the temperature in the motor 3 always is relatively high the relative humidity will be reduced even more, such that the remaining water vapour in the air does not tend to condense.

Although in the form of embodiment described here, the water, for lubricating the various slide bearings 17 and 23 and rotors 9 and 10, flows over the stator 19, the stator 19 may be cooled by a separate water circuit.

Within the scope of the invention, it is also possible that the blocking air fed to the inner space 20 originates from an external source instead of, as in the form of embodiment described here, from the compressor element 2 itself.

Figure 2:
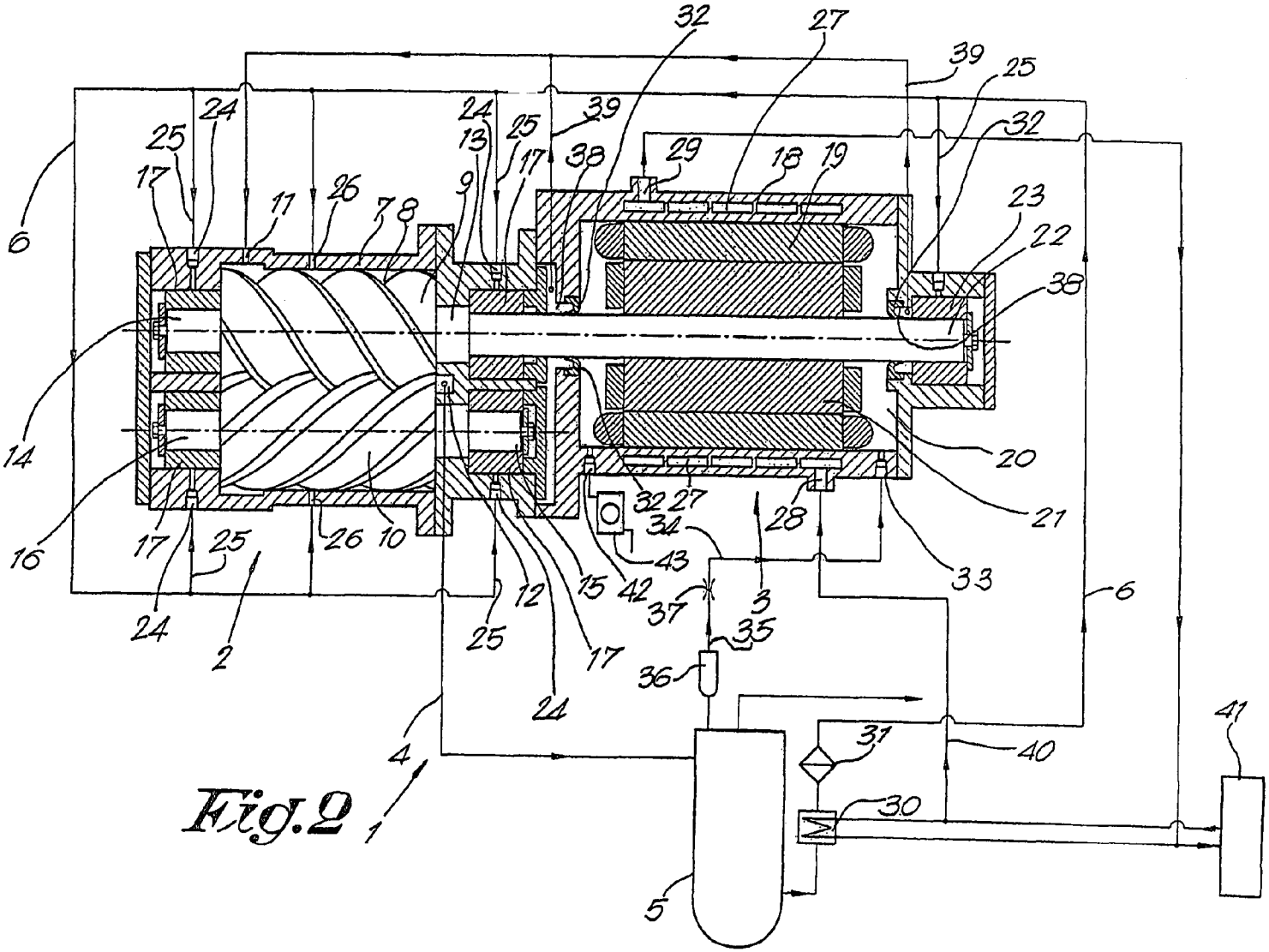
FIG. 2 schematically represents a water-injected screw compressor analogous to that of FIG. 1, however, in respect to another form of embodiment.

The form of embodiment according to FIG. 2 substantially differs from the form of embodiment described in the foregoing in that the channels 27 of said means for cooling the stator 19 are connected by means of conducts 40 to an external source of cooling water, schematically indicated by 41 in FIG. 2 and the housing 18 at the bottom is provided with one or more drain openings 42.

The fact that water from an external source 41 is used for cooling the housing 18 and thus the stator 19 instead of the internal source, this is the circuit used for lubricating the compressor element 2, has the advantage that this water contain less oxygen than the water of said circuit, is much colder and has less requirements as to the purity.

As the electrical motor 3 is situated adjacent a compressor element 2 under pressure and injected with water, and although already measures are taken to prevent the entry of water in the electrical motor 3, the form of embodiment according to FIG. 2 comprises extra measures to make the motor 3 more water resistant.

Therefore, the windings of the stator 19 and the rotor 21 are treated with an electrically insulating material, for example, silicones, against humidity.

The drain openings 42 discharge into a so-called "floating valve" 43. Such valve comprises a container, wherein the water is collected, and a float opening the outlet of the container when the liquid in it reaches a determined level.

The cooling water from the external source 41 is used as cooling medium in the cooler 30.

Due to the insulating material, for example, the silicones, a limited amount of humidity in the inner space 20 can be allowed.

Water entering accidentally the inner space 20 is transported off through one or more of said drain openings 42.

In both forms of embodiment, there is no gearwheel transmission between the motor 3 and the compressor element 2, and the housings 7 and 18 are integrated to form a whole. In total, only three bearings are required for the rotor shaft 22 and the axle ends 13 and 14 of the rotor 9. Consequently, the whole is relatively compact and inexpensive.

The heat produced by the high speed of the motor 3 can be transported off by means of the above-described means for cooling.

The present invention is in no way limited to the form of embodiment described as an example and represented in the figure; on the contrary may such water-injected screw compressor be realised in different forms and dimensions, without leaving the scope of the invention.

The invention claimed is:

1. Water-injected screw compressor, comprising a compressor element with a housing which borders a compression chamber in which a male rotor and a female rotor are installed, each rotor having axle ends borne in the housing by water-lubricated slide bearings, an electric motor for driving said compressor element, which motor comprises a housing which carries a stator within an inner space thereof, which stator surrounds a rotor with a rotor shaft, a pressure conduit which connects to the compression chamber, a vessel, which also is a water separator, in the pressure conduit, and a water return between the vessel and the compression chamber, wherein an axle end of one of the rotors is directly coupled to or is formed in one piece with the rotor shaft of the motor, said rotor shaft being located in a prolongation of said axle end, and wherein the rotor shaft of the motor is borne in at least one water-lubricated slide bearing;

wherein an inner space of the housing around a subassembly formed by the rotor shaft of the motor and the axle end connected thereto is sealed at an inside of each of the slide bearings situated at opposite sides of the rotor by a lip seal which is directed with a free extremity towards the respective slide bearing, whereas the inner space of the housing of the motor is in connection with a source of blocking gas under pressure via at least one conduit and said blocking gas from the inner space of the housing of the motor acts to lift the lip seals.

2. Water-injected screw compressor according to claim 1, wherein the rotor shaft of the motor is borne in a single slide bearing, at an extremity which is remote in respect to the compressor element.

3. Water-injected screw compressor according to claim 1, wherein the housing of the motor and the housing of the compressor element are integrated so as to form a whole.

4. Water-injected screw compressor according to claim 1, wherein the source of blocking gas is the pressure conduit or the vessel, wherein a water separator is installed in the conduit between the at least one pressure conduit or vessel and the inner space of the housing of the motor.

5. Water-injected screw compressor according to claim 1, wherein the housing of the motor is provided with at least one drain opening for water.

6. Water-injected screw compressor according to claim 1, wherein the at least one water-lubricated slide bearing of the rotor shaft of the motor is in connection with a source of water via a conduit.

7. Water-injected screw compressor according to claim 6, wherein the at least one water-lubricated slide bearing of the rotor shaft of the motor is in connection with the water return via a conduit.

8. Water-injected screw compressor according to claim 1, including an additional cooling means for cooling the stator.

9. Water-injected screw compressor according to claim 8, wherein the cooling means for cooling the stator comprises at least one channel which is provided through the housing of the motor and which is connected to a source of water.

10. Water-injected compressor according to claim 9, wherein the channel is connected to the water return or the vessel.

11. Water-injected screw compressor according to claim 9, wherein the channel is connected to an external source of cooling water.

* * * * *